US008881334B2

(12) United States Patent
Jossem et al.

(10) Patent No.: US 8,881,334 B2
(45) Date of Patent: Nov. 11, 2014

(54) BRISTLES, BRISTLE CARTRIDGES AND BRUSHES

(75) Inventors: Adam A. Jossem, Seattle, WA (US); Theresa H. Lee, Seattle, WA (US); David Hull, Seattle, WA (US)

(73) Assignee: Chef'n Corporation, Seattle, WA (US)

( * ) Notice: Subject to any disclaimer, the term of this patent is extended or adjusted under 35 U.S.C. 154(b) by 241 days.

(21) Appl. No.: 13/343,316

(22) Filed: Jan. 4, 2012

(65) Prior Publication Data

US 2012/0198642 A1 Aug. 9, 2012

Related U.S. Application Data

(60) Provisional application No. 61/430,886, filed on Jan. 7, 2011.

(51) Int. Cl.
*A46B 11/04* (2006.01)
*A46B 15/00* (2006.01)
*A46B 5/00* (2006.01)

(52) U.S. Cl.
CPC ..... *A46B 5/0008* (2013.01); *A46B 5/0095* (2013.01); *A46B 2200/207* (2013.01)
USPC ..... 15/176.1; 15/187; 15/202; 15/203

(58) Field of Classification Search
CPC ..... A46B 2200/207; A46B 7/04; A46B 11/00
USPC ..... 15/176.1, 176.4–176.6, 177, 146, 15/202–203, 171, 188, 187; 99/345
See application file for complete search history.

(56) References Cited

U.S. PATENT DOCUMENTS

| | | | | |
|---|---|---|---|---|
| 7,059,006 | B1 * | 6/2006 | Huff et al. | 15/146 |
| 2007/0143945 | A1 * | 6/2007 | DiPietro et al. | 15/188 |
| 2008/0257167 | A1 * | 10/2008 | Kerr et al. | 99/346 |
| 2010/0199449 | A1 * | 8/2010 | Ho et al. | 15/207.2 |

* cited by examiner

*Primary Examiner* — Laura C Guidotti
(74) *Attorney, Agent, or Firm* — Seed IP Law Group PLLC

(57) ABSTRACT

In one particular embodiment, a basting device incorporates a handle body, having a handle portion and a working portion, and a bristle cartridge removably coupled to the working portion of the handle body. The bristle cartridge has a set of first bristles projecting outwardly from the cartridge in a first direction and a set of second bristles projecting outwardly from the cartridge in a second direction different from the first direction. At least one of the first and second bristles has a proximal end and a distal end, the proximal end being attached to the bristle cartridge and the distal end having a slit therein extending from the distal end toward the proximal end. The slit has a width sized to cause fluid to be drawn into the slit through capillary action when the distal end of the bristle is submerged in the fluid.

9 Claims, 9 Drawing Sheets

BRISTLES, BRISTLE CARTRIDGES AND BRUSHES

BACKGROUND OF THE INVENTION

1. Field of the Invention

The present invention is generally directed toward cooking tools, and more particularly to basting brushes, pastry brushes and the like.

2. Description of the Related Art

Basting brushes are used for moistening and/or coating food. The basting medium can be melted butter, meat drippings, sauces, or any other liquid or paste that may add color, flavor, or moisture, or any combination thereof to food.

Depending on the type of basting being done, the bristle design can vary. For example, barbeque basters typically have large bristles for carrying large amounts of thick barbeque sauce, while pastry brushes typically have shorter, thinner bristles for carrying smaller amounts of thin fluids such a butter or icing. A chef often will use more than one type of basting brush.

Basting brushes traditionally used a conventional brush, which is difficult to clean because of numerous fibers positioned in close proximity to one another. Additionally, the brush fibers typically tend to shed during use, deposited on the food being cooked. More recently, basters have been made with silicone brushes to prevent shedding; however, the brush designs often attempt to emulate the structure of conventional brushes, namely, positioning fibers in a parallel and dense configuration. Because silicone does not absorb liquid, however, such brushes typically do not function as well as brushes made with hair.

BRIEF SUMMARY OF THE INVENTION

In one embodiment, a basting device includes a handle body and a bristle cartridge. The elongated body has a handle portion toward its proximal end and a working portion toward its distal end. The handle portion is adapted to conform to a user's grip and allow the user to manipulate the device. The bristle cartridge is removably coupled to the working portion of the handle body. The bristle cartridge has a set of first bristles projecting outwardly from the cartridge in a first direction and a set of second bristles projecting outwardly from the cartridge in a second direction different from the first direction. A user of the device can at one time use the device to baste with the first bristles, then, by removing, inverting and replacing the bristle cartridge, can at another time use the device to baste with the second bristles.

In another embodiment, the handle portion is adapted to conform to a user's grip and allow the user to manipulate the device; and the bristle cartridge is removably coupled to the working portion of the handle body. The bristle cartridge has a set of first bristles projecting outwardly from the cartridge in a first direction and a set of second bristles projecting outwardly from the cartridge in a second direction different from the first direction. At least one of the first and second bristles has a proximal end and a distal end. The proximal end of that particular bristle is attached to the bristle cartridge and the distal end has a slit therein extending from the distal end toward the proximal end. The slit has a width sized to cause fluid to be drawn into the slit through capillary action when the distal end of the bristle is submerged in the fluid. A user of the device can at one time use the device to baste with the first bristles, then, by removing, inverting and replacing the bristle cartridge, can at another time use the device to baste with the second bristles.

In yet another embodiment, the basting device incorporates a handle body and a set of bristles. The handle body has a handle portion toward its proximal end and a working portion toward its distal end. The handle portion is adapted to conform to a user's grip and allow the user to manipulate the device. The set of bristles projects outwardly from the working portion of the body. At least one of the bristles has a proximal end and a distal end, with the proximal end being attached to the working end of the body and the distal end having a slit therein. The slit, which extends from the distal end toward the proximal end, has a width sized to cause fluid to be drawn into the slit through capillary action when the distal end of the at least one bristle is submerged in the fluid.

In still another embodiment, a kit for basting foods incorporates a handle body and more than one bristle cartridge. The elongated handle body has a handle portion toward its proximal end and a working portion toward its distal end. The handle portion is adapted to conform to a user's grip and allow the user to manipulate the device. The bristle cartridges are removably coupleable to the working portion of the body such that several bristle cartridges can be used in connection with a single handle.

BRIEF DESCRIPTION OF THE SEVERAL VIEWS OF THE DRAWING(S)

DETAILED DESCRIPTION OF THE INVENTION

Figure 1:
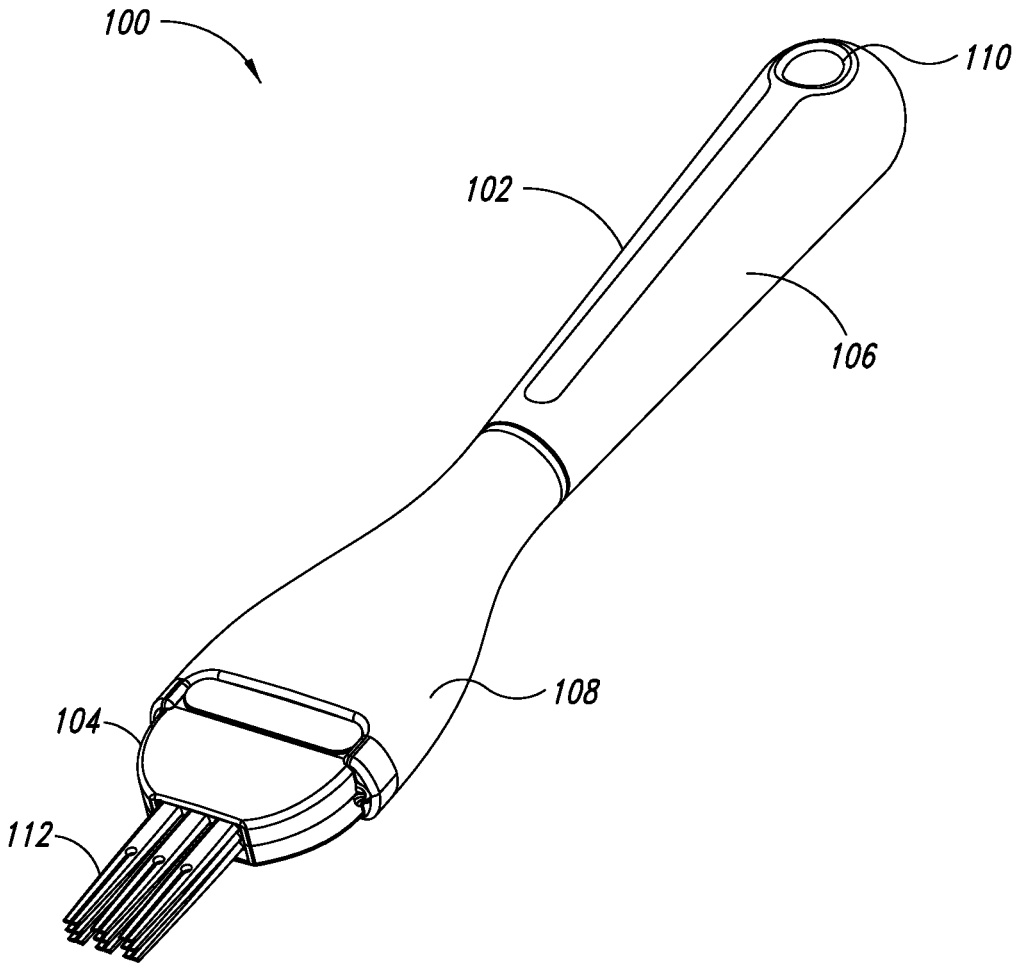
FIG. 1 is a perspective view of a basting device according to one embodiment of the present invention.
Figure 2:
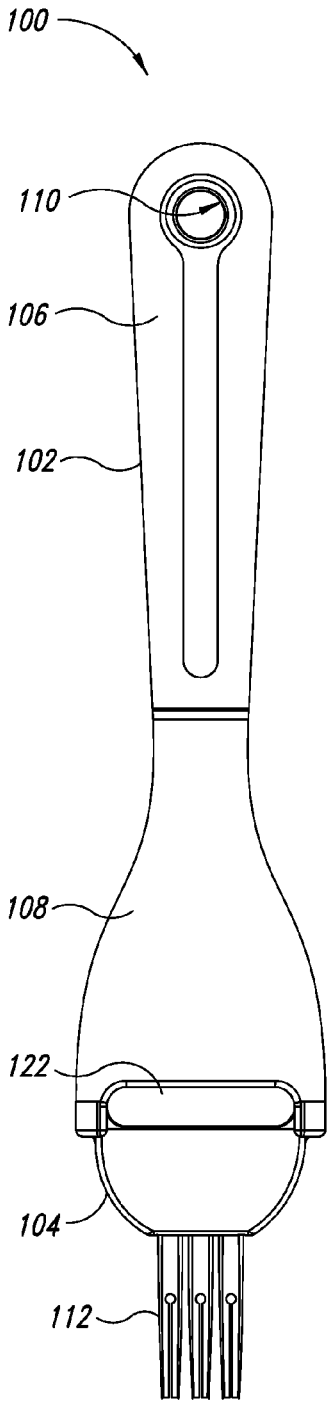
FIG. 2 is a front view of the basting device of FIG. 1.

This disclosure is generally directed toward basting brushes, pastry brushes and the like. In some aspects, brushes can allow users to remove, replace and/or reconfigure bristle cartridges to change the size, shape and/or function of the respective bristles. In some aspects, brushes can incorporate wide bristles with slits in them configured to capture liquid as a result of capillary action. The following detailed description and the corresponding drawings depict and describe selected embodiments of the inventive brushes.

An individual of ordinary skill in the art, having reviewed the disclosure in its entirety, will immediately appreciate that details and features can be added, removed and/or changed without deviating from the spirit of the invention. As such, reference throughout this specification to "one embodiment"

or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

FIGS. 1, 2, 3A, 3B and 4 illustrate an embodiment of a basting device 100 according to one embodiment of the present invention. The basting device 100 comprises an elongated body 102 and a bristle cartridge 104. The body 102 extends from a handle portion 106 to a working portion 108. The handle portion 106 is adapted to be held in one hand by a user, and can be formed, shaped, coated, covered or otherwise modified to fit comfortably in the user's hand, to provide a suitable grip, to allow for comfortable and effective manipulation, and/or to meet any other suitable needs. The illustrated body 102 has an aperture 110 near a terminal end of the working portion, which can be used to hang the basting device 100 by a hook or other structure. An individual of ordinary skill in the art, having reviewed this entire disclosure, will appreciate that a wide variety of modifications and/or additions can be made to the handle portion 106 without deviating from the spirit of the invention.

The bristle cartridge 104 in the illustrated embodiment is removably attached to the working portion 108 of the body 102. A set of long bristles 112 projects outward from a distal end of the bristle cartridge 104, beyond the working portion 108 of the body 102. The illustrated bristle cartridge 104 has twelve long bristles 112, arranged in an array three bristles wide and four bristles tall. The size, shape and configuration of the illustrated set of long bristles 112 may be suitable for use as a pastry brush or for other suitable purposes. An individual of ordinary skill in the art, having reviewed this entire disclosure, will appreciate that the size, shape, configuration and other details related to the long bristles 112 can be modified without deviating from the spirit of the invention.

Figure 3A:
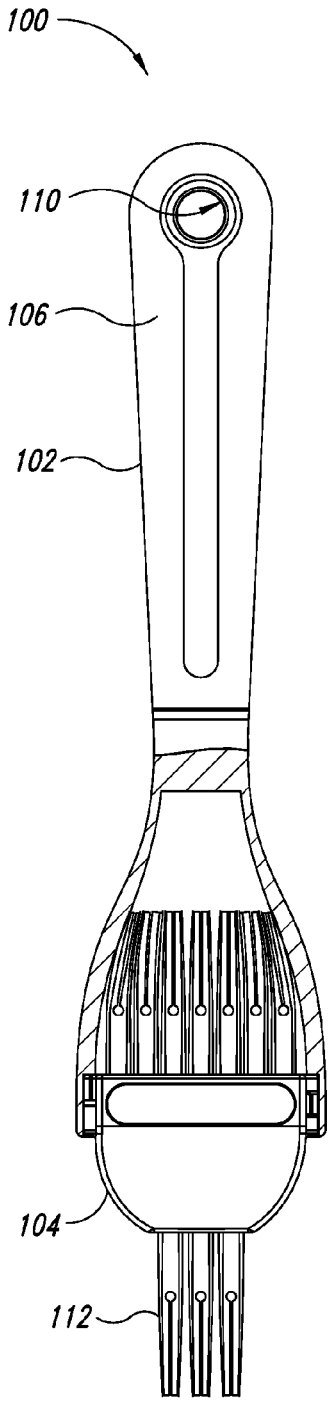
FIG. 3A is a partially exposed front view of the basting device of FIG. 1, shown in a first configuration.
Figure 3B:
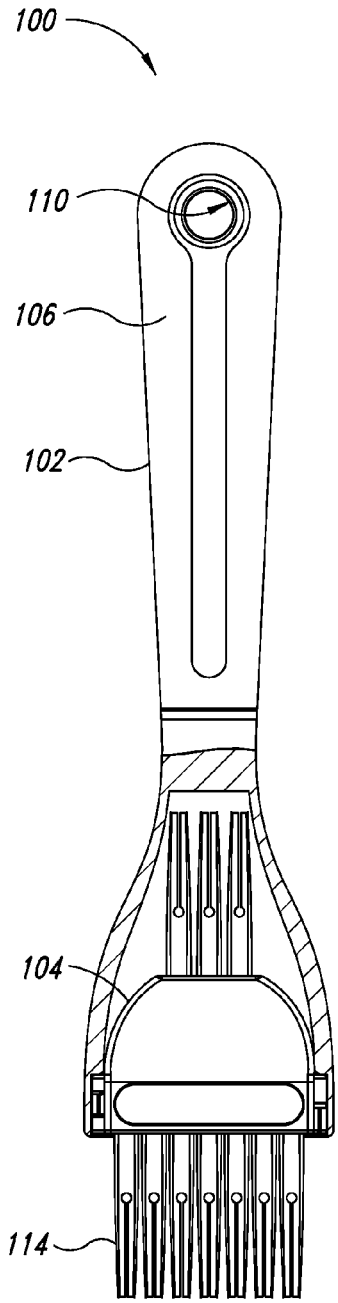
FIG. 3B is a partially exposed front view of the basting device of FIG. 1, shown in a second configuration.

As best illustrated in FIGS. 3A and 3B, the bristle cartridge 104 is removably attached to the working end 108 of the body 102 to allow the bristle cartridge to be removed, rotated, and replaced such that a set of short bristles 114 project from the basting device 100. The illustrated bristle cartridge 104 has twenty-eight short bristles 114 projecting therefrom, arranged in an array seven bristles wide and four bristles tall (as oriented when the brush 100 is laying on a table). As with the long bristles 112, the short bristles 114 can be modified without deviating from the spirit of the invention. The illustrated bristle cartridge 104 also has only two sets of bristles. An individual of ordinary skill in the art, having reviewed this entire disclosure, will appreciate that changes can be made to the illustrated embodiment to allow for three or more sets of bristles, all without deviating from the spirit of the invention.

The illustrated basting device 100 incorporates a press fit capture system in which the bristle cartridge 104 is captively received in the body 102 in both the orientation illustrated in FIG. 3A and also the orientation shown in FIG. 3B, but can be removed manually as desired by the user.

Figure 3C:
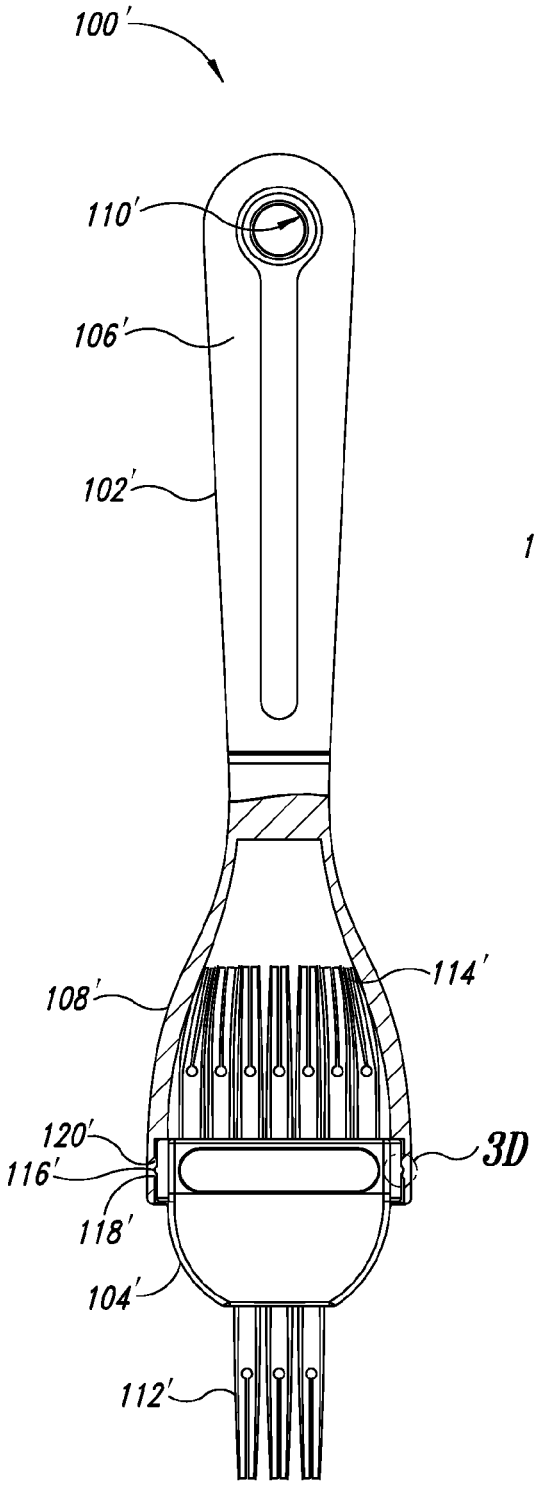
FIG. 3C is a partially exposed front view of a basting device according to another embodiment of the present invention.
Figure 3D:
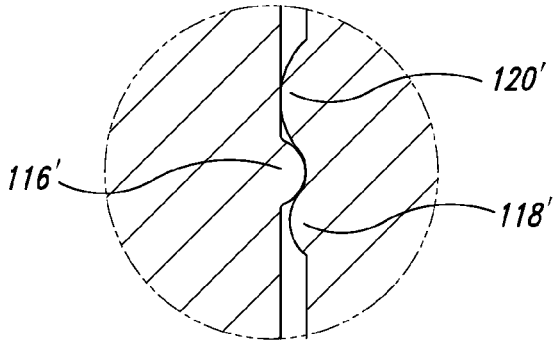
FIG. 3D is an enlarged view of a portion of the device of FIG. 3C.
Figure 4:
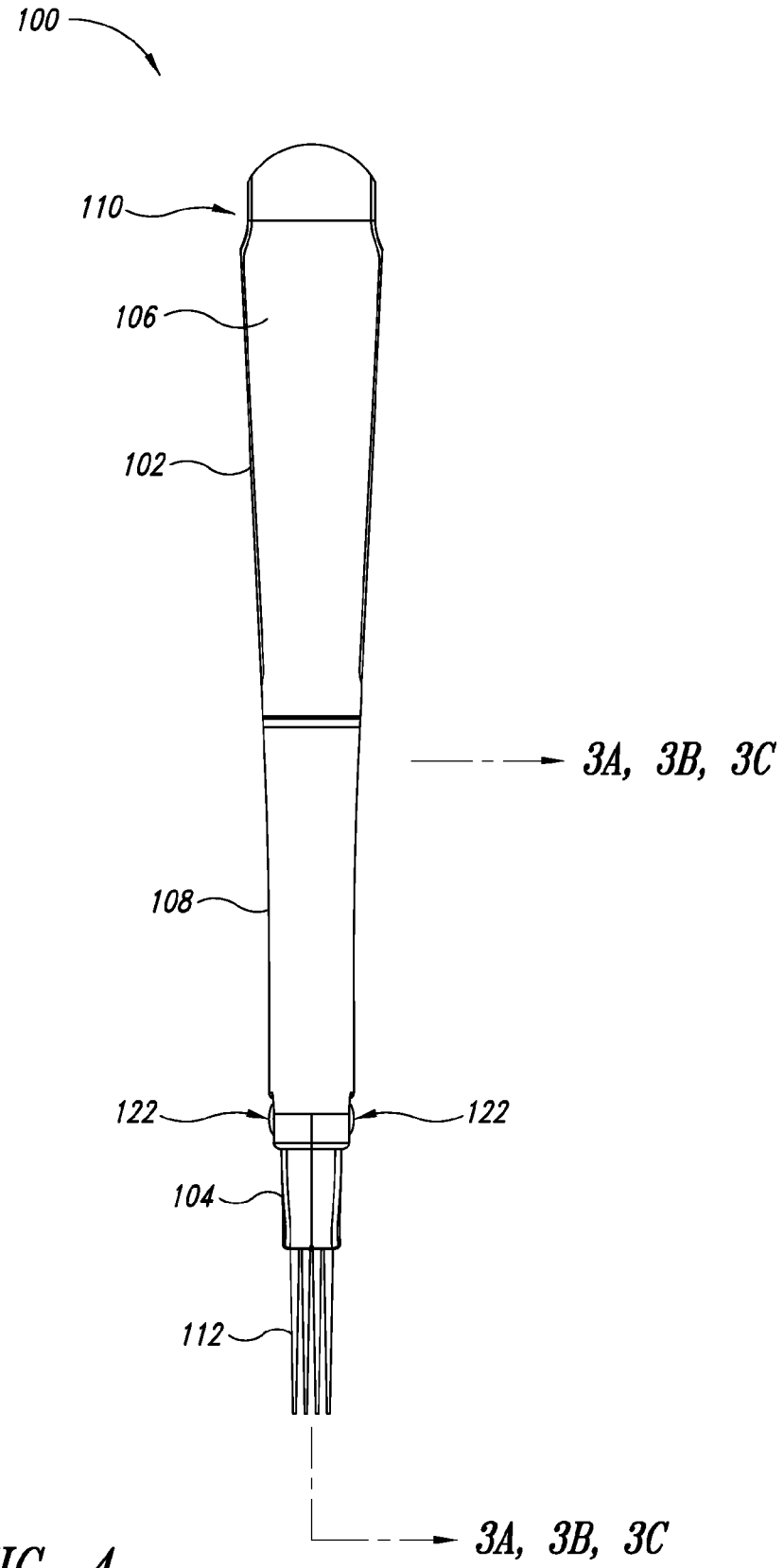
FIG. 4 is a side view of the basting device of FIG. 1.
Figure 5:
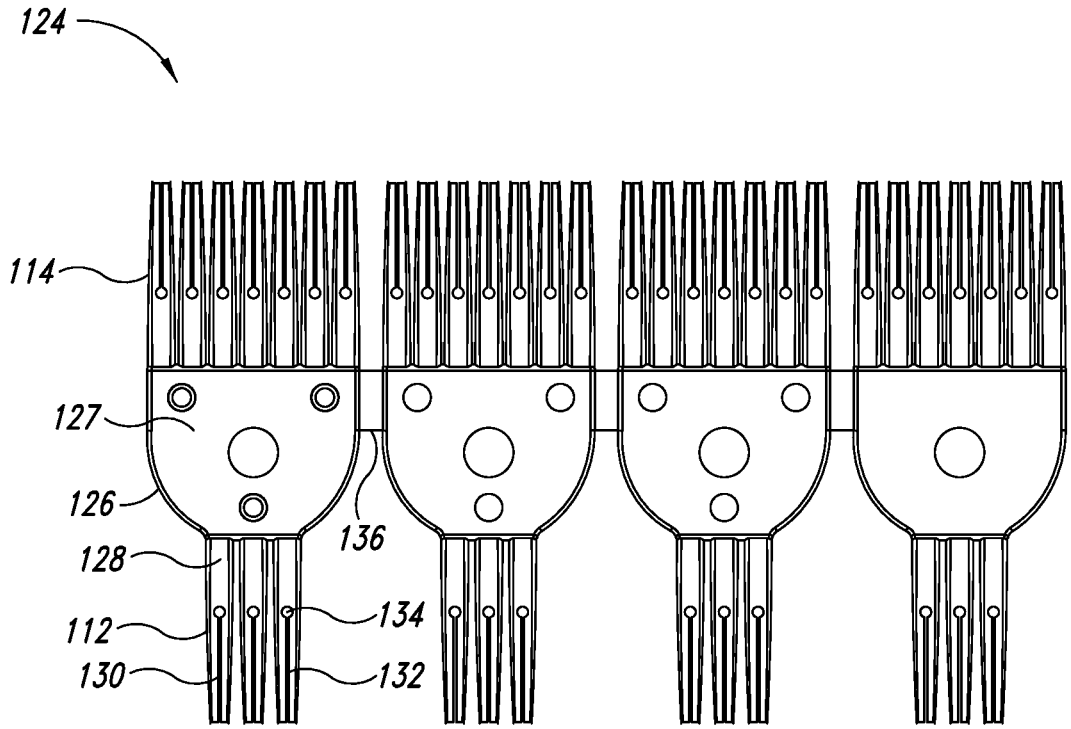
FIG. 5 is a front view of a set of bristles for use in the basting devices of FIG. 1 and FIG. 3C, shown in an unfolded configuration.
Figure 6:
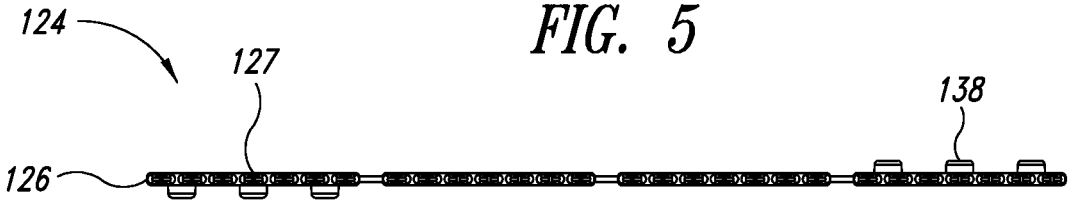
FIG. 6 is a top view of the set of bristles of FIG. 5.

The alternate embodiment of the basting device 110' illustrated in FIGS. 3C and 3D incorporates a detent-style capture system for releasably retaining the bristle cartridge 104' in the body 102'. The illustrated bristle cartridge 104' has a protuberance 116' on each of its opposing lateral sides. An inner mouth of the working portion 108' of the body 102' has opposing pairs of small projections 118' and large projections 120' sized, shaped and positioned to allow the protuberances 116' on the bristle cartridge 104' to slide past the small projection and stop against the large projection, capturing the bristle cartridge between the two. The protuberances 116', small projections 118' and large projections 120' are configured to capture the bristle cartridge 104' in the working end 108' of the body 102' in both configurations. An individual of ordinary skill in the art, having reviewed this entire disclosure, will immediately appreciate that a variety of alternate capture systems could be used instead of the illustrated capture system, all without deviating from the spirit of the invention.

Returning to the embodiment illustrated in FIGS. 1, 2, 3A, 3B and 4, the illustrated bristle cartridge 104 incorporates a concave recess 122 on opposing faces to facilitate insertion and removal of the bristle cartridge 104 with respect to the working end 108 of the body 102. The user can squeeze the opposing recesses 122 to pinch the bristle cartridge 104 in one hand, and can insert the bristle cartridge into or remove the bristle cartridge from the working end 108 with one hand while the other hand holds the body 102. Any suitable feature for facilitating retention of the bristle cartridge 104 in one hand would suffice.

FIGS. 5-8 show one embodiment of a sheet 124 of bristles, the illustrated embodiment containing all of the long bristles 112 and the short bristles 114. The illustrated sheet 124 is in the form of a unitary silicone layer 126 molded or otherwise formed to delineate a central base portion 127 and opposing long and short bristles 112, 114. The illustrated base portion 127 has a shape complementary to that of the bristle cartridge 104. As such, the base portion 127 can be captively housed within and hidden by the bristle cartridge 104 when assembled. The long bristles 112 project from one end of the base portion 127 (and bristle cartridge 104) and the short bristles 114 project from an opposing end of the base portion (and bristle cartridge). As indicated above, this configuration can be changed, as desired.

In the illustrated embodiment, each of the bristles—both the long bristles 112 and the short bristles 114—has a proximal end 128 fixed to the base portion 127 and an opposing distal end 130 projecting outward, away from the base portion. The distal ends 130 of the illustrated bristles are unrestrained. In the illustrated embodiment, the bristles are solid silicone and, as such, are extremely flexible and resilient. An individual of ordinary skill in the art, having reviewed this disclosure in its entirety, will appreciate that some or all of the bristles can be partially or completely hollow, can be made from one or more different materials and/or combinations of materials, can have an internal material partially or completely over-molded by another material, or can be manufactured using other suitable methods.

The terminal distal end 130 of the illustrated is blunt and squared off; however the bristle can have any suitable shape. The distal end 130 portion of each illustrated bristle is split lengthwise into two halves, the halves divided by a slit 132 extending from the extreme distal end of each bristle at least part of the way toward the proximal end 128 of the bristle. The slit 132 could divide the distal end 130 portion of the bristle unevenly if necessary or desirable for any particular reason. The split bristles can have the feel and function of a basting brush, a pastry brush or the like, based on the material, length, thickness and/or other criteria used in modifying the design.

The slit 132 is narrow enough to cause fluid to rise along the slit under capillary forces when the extreme distal end 130 of the bristle is submerged in a fluid. In certain embodiments the slit 132 can be 0.5 mm in width, can be 1.0 mm in width, or can be wider. Likewise, if necessary or desirable under particular circumstances, the slit 132 could be narrower. One of ordinary skill in the art, having reviewed this entire disclosure, will immediately appreciate the range of widths that would be appropriate for capturing by capillary forces fluids of various viscosities.

The illustrated slit 132 extends more than ¼, more than ½ and approximately ⅔ the length of the bristle. The length of the slit 132 can be longer or short, as necessary or desirable based on function, material or other factors.

The slit 132 in the illustrated embodiment terminates in an enlarged aperture 134. The aperture 134 can allow the bristle to capture more fluid that would otherwise be captured in the slit 132 alone.

The illustrated layer 126 is made up of four central base portions 127 connected together by thin webs 136 of the material of the layer. In alternate embodiments, the webs 136 could be made from a different material, over-molded by the material of the layer 126. One of ordinary skill in the art, having reviewed this entire disclosure, will immediately appreciate that this and other changes could be made to the design without deviating from the spirit of the invention.

Figure 7:
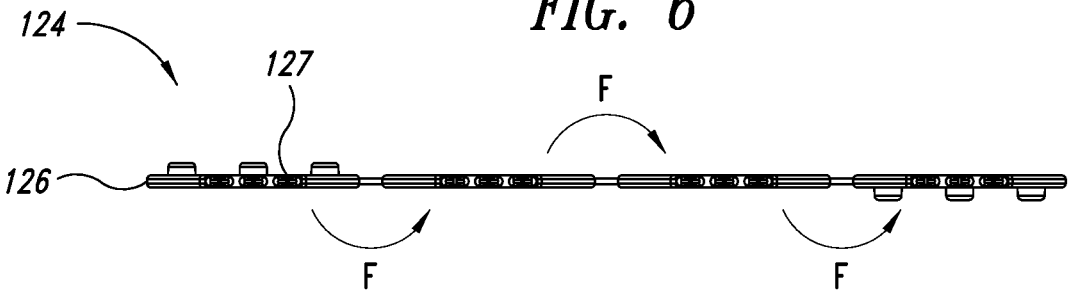
FIG. 7 is a bottom view of the set of bristles of FIG. 5.
Figure 8:
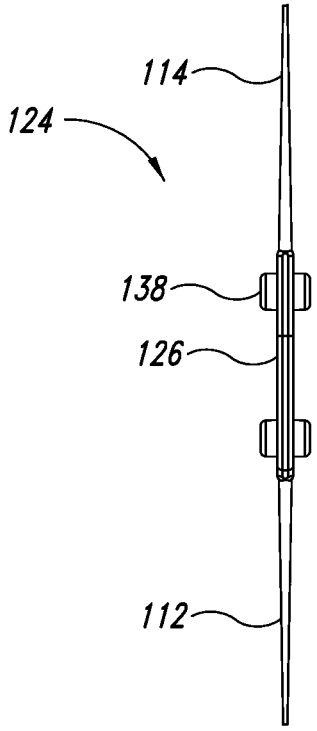
FIG. 8 is an end view of the set of bristles of FIG. 5.
Figure 9:
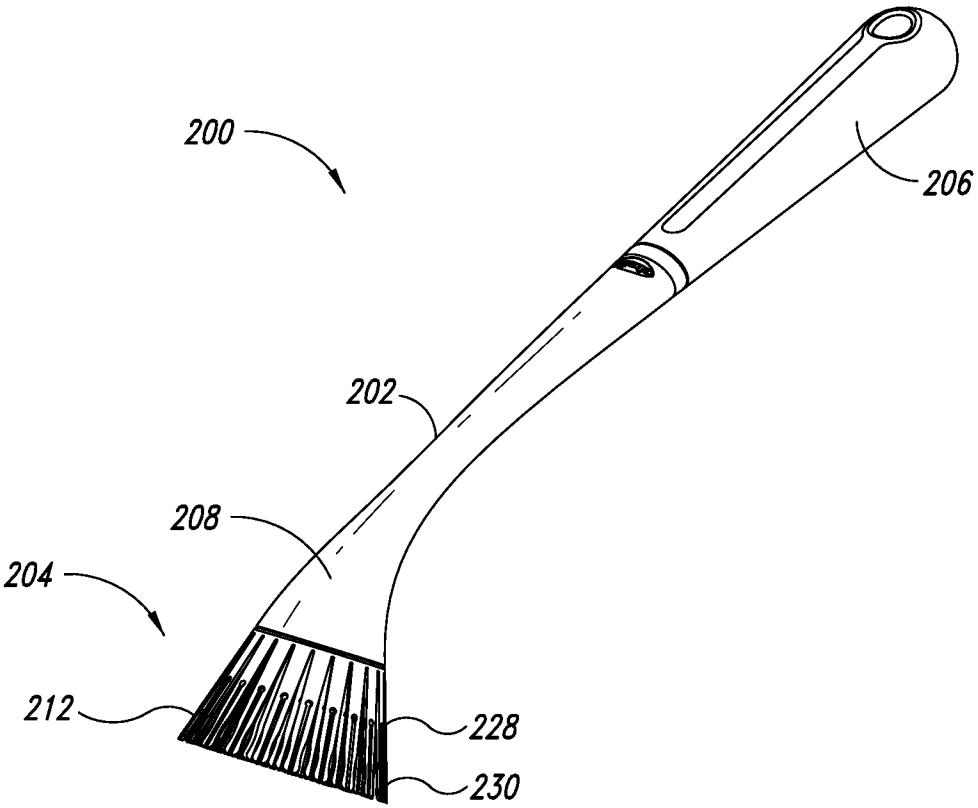
FIG. 9 is a perspective view of a basting device according to yet another embodiment of the present invention.
Figure 10:
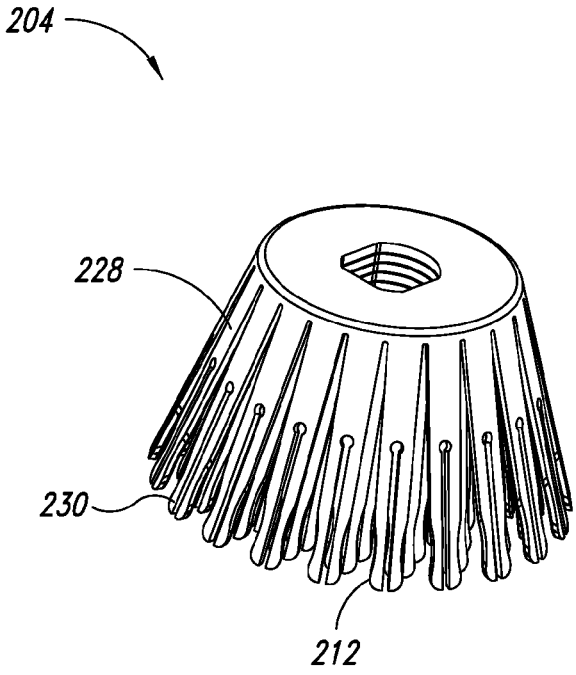
FIG. 10 is a perspective view of a set of bristles for the basting device of FIG. 9.
Figure 11:
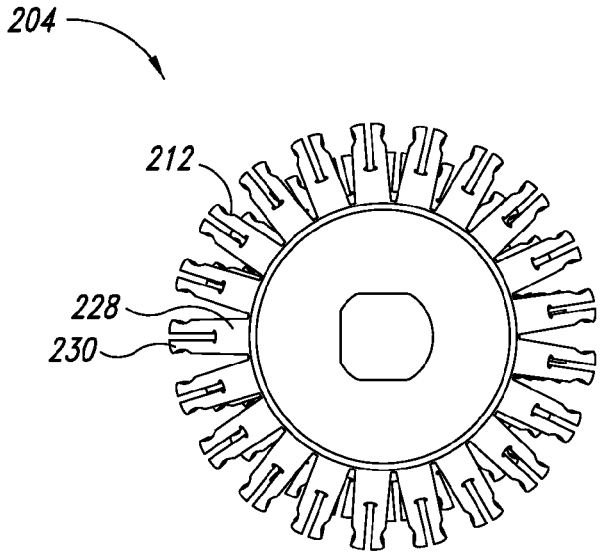
FIG. 11 is a top view of the set of bristles of FIG. 10.
Figure 12:
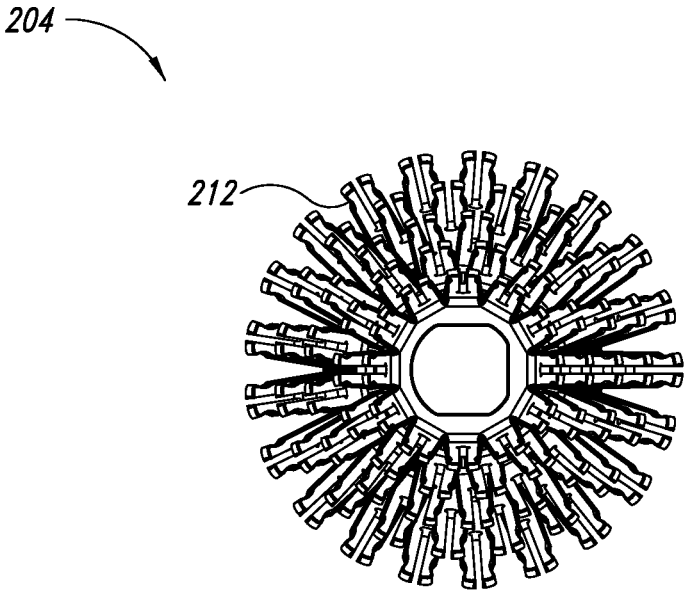
FIG. 12 is a bottom view of the set of bristles of FIG. 10.

To assemble the illustrated basting device 100, the central base portions 127 are folded, such as along fold arrows "F" in FIG. 7, until the four base portions are layered one on top of the other. The folded base portions 127 can then be captured within the body of the bristle cartridge 104. One or more bosses 138 or other features can be used to cause the folded bristle layer 126 to remain fixed with respect to the bristle cartridge 104 during use.

FIGS. 9-12 show one alternate embodiment of a basting device 200 comprising a handle body 202—the body having a handle portion 206 and a working portion 208—and a bristle cartridge 204. In this particular embodiment, the bristle cartridge 204 has only one set of bristles 212; however, it can be removable for washing or being replaced by a separate bristle cartridge with a different number, size and/or type of bristles. The illustrated bristles 212 are arranged in annular rings and are tapered outward from their proximal ends 228 to their distal ends 230. The individual bristles 212 in this embodiment can be the same or similar to those described in connection with the above embodiment.

As illustrated in the alternate embodiment, the size, shape, bristle number and/or configuration, and many other features and details of the invention can be modified without deviating from the spirit of the invention.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A basting device for applying a basting medium to a food, the basting device comprising:

an elongated body having a handle portion toward its proximal end and a working portion toward its distal end, the handle portion being adapted to conform to a user's grip and allow the user to manipulate the device; and a bristle cartridge removably coupled to the working portion of the body, the bristle cartridge having a set of first bristles projecting outwardly from the cartridge in a first direction and a set of second bristles projecting outwardly from the cartridge in a second direction different from the first direction; whereby the user can at one time use the device to baste with the first bristles, then, by removing, inverting and replacing the bristle cartridge, can at another time use the device to baste with the second bristles.

2. The basting device of claim 1 wherein the first bristles are different than the second bristles.

3. The basting device of claim 1 wherein the first bristles are wider than the second bristles.

4. The basting device of claim 1 wherein the first bristles are longer than the second bristles.

5. The basting device of claim 1 wherein the second direction is at least substantially opposite the first direction.

6. The basting device of claim 1 wherein at least one of the first and second bristles has a proximal end and a distal end, the proximal end being attached to the bristle cartridge and the distal end having a slit therein extending from the distal end toward the proximal end.

7. The basting device of claim 1 wherein at least one of the first and second bristles has a proximal end and a distal end, the proximal end being attached to the bristle cartridge and the distal end having a slit therein extending from the distal end toward the proximal end, the slit terminating in an enlarged aperture extending through an entire thickness of the bristle.

8. The basting device of claim 1 wherein at least one of the first and second bristles has a proximal end and a distal end, the proximal end being attached to the bristle cartridge and the distal end having a slit therein extending from the distal end toward the proximal end, the slit having a width sized to cause fluid to be drawn into the slit through capillary action when the distal end of the bristle is submerged in the fluid.

9. A basting device for applying a basting medium to a food, the basting device comprising:

an elongated body having a handle portion toward its proximal end and a working portion toward its distal end, the handle portion being adapted to conform to a user's grip and allow the user to manipulate the device; and a bristle cartridge removably coupled to the working portion of the body, the bristle cartridge having a set of first bristles projecting outwardly from the cartridge in a first direction and a set of second bristles projecting outwardly from the cartridge in a second direction different from the first direction, at least one of the first and second bristles having a proximal end and a distal end, the proximal end being attached to the bristle cartridge and the distal end having a slit therein extending from the distal end toward the proximal end, the slit having a width sized to cause fluid to be drawn into the slit through capillary action when the distal end of the bristle is submerged in the fluid; whereby the user can at one time use the device to baste with the first bristles, then, by removing, inverting and replacing the bristle cartridge, can at another time use the device to baste with the second bristles.

* * * * *